US007370592B2

(12) United States Patent
Tajima et al.

(10) Patent No.: US 7,370,592 B2
(45) Date of Patent: May 13, 2008

(54) SEWING MACHINE

(75) Inventors: Ikuo Tajima, Nagaoya (JP); Tetsurou Kondou, Tajimi (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 52 days.

(21) Appl. No.: 10/595,925

(22) PCT Filed: Nov. 16, 2004

(86) PCT No.: PCT/JP2004/017013

§ 371 (c)(1),
(2), (4) Date: Jul. 5, 2006

(87) PCT Pub. No.: WO2005/049907

PCT Pub. Date: Jun. 2, 2005

(65) Prior Publication Data

US 2007/0137540 A1 Jun. 21, 2007

(30) Foreign Application Priority Data

Nov. 19, 2003 (JP) ..... 2003-389795

(51) Int. Cl.
*D05B 69/02* (2006.01)
*D05B 53/00* (2006.01)

(52) U.S. Cl. ..... 112/220; 112/99; 112/254; 112/302; 112/113

(58) Field of Classification Search ..... 112/98, 112/99, 113, 139, 152, 220, 254, 255, 302, 112/305, 470.33; 242/410, 412.2, 420, 550, 242/554.4, 598, 155 R, 157 R
See application file for complete search history.

(56) References Cited

U.S. PATENT DOCUMENTS 523,522 A * 7/1894 Haas et al. ..... 112/98
740,654 A * 10/1903 Hochstrasser ..... 112/99
797,308 A * 8/1905 Nassberg ..... 112/99
1,004,912 A * 10/1911 Russell ..... 112/99

(Continued)

FOREIGN PATENT DOCUMENTS

JP 3-286797 A 12/1991
JP 2003-320189 A 11/2003

OTHER PUBLICATIONS

Relevant portion of International Search Report of corresponding PCT Application PCT/JP2004/017013.

*Primary Examiner*—Ismael Izaguirre
(74) *Attorney, Agent, or Firm*—Rossi, Kimms & McDowell, LLP

(57) ABSTRACT

Sewing machine includes a tension detection section (26) for detecting tension acting on a sewn material (A) paid out from a rotary holder member, and a drive section for driving the rotary holder member, and the driving operation of the drive section (14) is controlled on the basis of the detection by the tension detection section. Once the tension acting on the sewn material has increased, the rotary holder member is driven to rotate by the drive section, so that the sewn material can be paid out smoothly from the rotary holder member. The sewing machine is particularly useful in a case where the rotary holder member is constructed into an increased size so that an increased amount of the sewn material can be wound thereon.

10 Claims, 5 Drawing Sheets

U.S. PATENT DOCUMENTS 1,356,762 A * 10/1920 Groebli ..... 112/99
4,009,674 A 3/1977 Ladd
5,029,543 A * 7/1991 Trojan ..... 112/152
5,178,081 A * 1/1993 von-Hagen et al. .... 112/470.33
5,404,824 A * 4/1995 Hiraoka et al. ..... 112/254
5,615,628 A * 4/1997 Tajima et al. ..... 112/220

* cited by examiner

SEWING MACHINE

This application is a U. S. National Phase Application of PCT International Application PCT/JP2004/017013 filed on Nov. 16, 2004.

TECHNICAL FIELD

The present invention relates generally to sewing machines of a type which sews a string material, such as a tape or cord, to a fabric through lock switching. More particularly, the present invention relates to an improved sewing machine in which a bobbin having a string material wound thereon is disposed above a needle bar so that it can have an increased size, and which allows the string material to be smoothly paid out from the bobbin by positively rotating the bobbin as necessary when the string material is to be sewn to a fabric.

BACKGROUND ART

There have been known sewing machines of a type which includes a vertically driven needle bar, a sewing needle fixed to a lower end portion of the needle bar, a rotary member mounted concentrically with the needle bar and freely rotatable about the axis and a guide fixed to the rotary member for guiding the string material (i.e., string-shaped embroidering member, such as a tape or cord) to a sewing position of the sewing needle. The sewing machines of the type operate to sew the string material to a fabric through lock stitching, by the rotation of the rotary member being appropriately controlled in accordance with a moving direction of a fabric based on embroidery data and by the orientation of the guide being appropriately varied to optimize the direction in which the string material is guided to the sewing position of the sewing needle. One example of such sewing machines is known from Japanese Patent Application Laid-open Publication No. HEI-3-286797. The No. HEI-3-286797 publication discloses a sewing machine of the above-mentioned type, where a bobbin having a string material wound thereon has an increased size by being disposed in a space above the needle bar. The bobbin having the string material wound thereon is mounted on a bobbin shaft supported at its opposite ends by a pair of support members fixed to a machine frame, and the bobbin is supported at its opposite end portions by a pair of retaining members mounted on the bobbin shaft. First guide roller for winding the string material from the bobbin to invert upwardly the feed direction of the string material is rotatably provided beneath a substantial middle region of the bobbin. Roller support frame is rotatably mounted at its proximal end portion to the pair of support members, and a second guide roller for winding thereon the string material, inverted by the first guide roller, and further inverting downward the direction of the string material is rotatably mounted to a portion of the roller support frame corresponding in position to the substantial middle region of the bobbin. Coil spring is provided on the roller support frame for normally biasing the roller support frame in the upward direction, and a brake member is also provided on the roller support frame in such a manner that it can be brought to frictional contact with the retaining members when necessary.

The string material paid out from the bobbin is guided to the sewing position via the first guide roller and second guide roller. As the second guide roller is pulled by the string material in accordance with a progression of sewing of the string material, the roller support frame is caused to pivot downward and the bobbin is rotated by being pulled by the string material so that the string material is paid out from the bobbin. As the tension of the string material decreases by the paying-out of the string material, the roller support frame is caused to pivot upward by the biasing force of the coil spring. Once the roller support frame is caused to pivot further upward by the string material being paid out sufficiently, the brake member is brought to frictional contact with the retaining members, which terminates the rotation of the bobbin and thereby inhibits inertial rotation (overrun) of the bobbin. In such a sewing machine, where the bobbin having the string material wound thereon is located above the needle bar, the bobbin can have an increased size so that an increased amount of the string material can be wound on the bobbin.

In the conventionally-known sewing machines like the one disclosed in the HEI-3-286797 publication, as the string material is paid out from the bobbin and sewn onto a fabric, the bobbin is rotated by being pulled by the string material, in accordance with a progression of the sewing operation, so that the string material is further paid out from the bobbin, as set forth above. However, because the large-size bobbin having an increased amount of the string material wound thereon would have an increased overall weight, an extremely great force would be required to rotate the bobbin in order to pay out the string material. Thus, if the bobbin is very heavy in weight, the rotation of the bobbin tends to be slow so that the paying-out of the string material is delayed behind the sewing operation, and the bobbin tends to start rotating rapidly so that the string material may be paid out more than necessary. Further, depending on the weights of the bobbin and string material, the bobbin may fail to rotate even when it is pulled by the string material being sewn, in which case the string material may not be paid out at all. Thus, the convention sewing machines would suffer from the inconveniences that the string material can not be paid out smoothly, the string material can not be sewn accurately and beautifully or aesthetically and the sewing of the string material is undesirably halted.

SUMMARY OF THE INVENTION

It is an object of the present invention to provide an improved sewing machine which allows a sewn material (string material) to be smoothly paid out from a bobbin even if the bobbin has an increased size so that an increased amount of sewn material (string material) can be wound thereon and the bobbin is heavy in weight.

The present invention provides a sewing machine including: a reciprocally-driven needle bar; a sewing needle fixed to the distal end of the needle bar; a rotary member provided concentrically with the needle bar for rotation about the axis of the needle bar; a rotary holder member having an elongated sewn material wound thereon; and a guide for guiding the sewn material, paid out from the rotary holder member, to a sewing position of the sewing needle, the guide being provided for rotation together with the rotary member, the sewing machine sewing the sewn material onto an object of sewing while appropriately adjusting the orientation of the guide by controlling the rotation of the rotary member. The sewing machine comprises: a tension detector that detects tension acting on the sewn material paid out from the rotary holder member; and a drive device that drives the rotary holder member to rotate, and the driving operation of the drive device is controlled on the basis of detection, by the tension detector, of the tension.

According to the present invention, the tension detector detects the tension acting on the sewn material (e.g., string material) paid out from the rotary holder member (bobbin), the drive device drives the rotary holder member, and the driving operation of the drive device is controlled on the basis of the tension detection by the tension detector. Thus, when the sewn material (e.g., string material) is to be paid out from the rotary holder member (bobbin) and sewn onto the object of sewing (fabric), the drive device can be activated to drive or rotate the rotary holder member (bobbin) once the tension acting on the sewn material has increased due to the weight of the rotary holder member (bobbin) and other causes, which thereby allows the sewn material (e.g., string material) to be paid out smoothly. For example, once the sewn material (e.g., string material) has been paid out sufficiently to decrease the tension, the driving operation of the drive device is terminated to stop the paying-out of the string material. By positively rotating the bobbin in accordance with the tension acting on the string material in the aforementioned manner, the string material can be paid out smoothly, with the result that the string material can be sewn accurately and beautifully or aesthetically.

Further, according to the present invention, the rotary holder member (bobbin) having the sewn material (string material) wound thereon is positioned in a space above the needle bar. Thus, the invention is particularly useful in a case where the rotary holder member (bobbin) is constructed into a large size such that an increased amount of sewn material can be wound thereon. Namely, in the present invention, the rotary holder member (bobbin) is positively rotated by the drive device in accordance with the tension acting on the string material, and thus, even where the large-size rotary holder member (bobbin) is heavy in overall weight with a great amount of the sewn material (string material) wound thereon, the present invention achieves the superior benefit that the sewn material (string material) can be paid out appropriately and sewn onto the object of sewing accurately and beautifully.

DETAILED DESCRIPTION OF THE INVENTION

Figure 1:
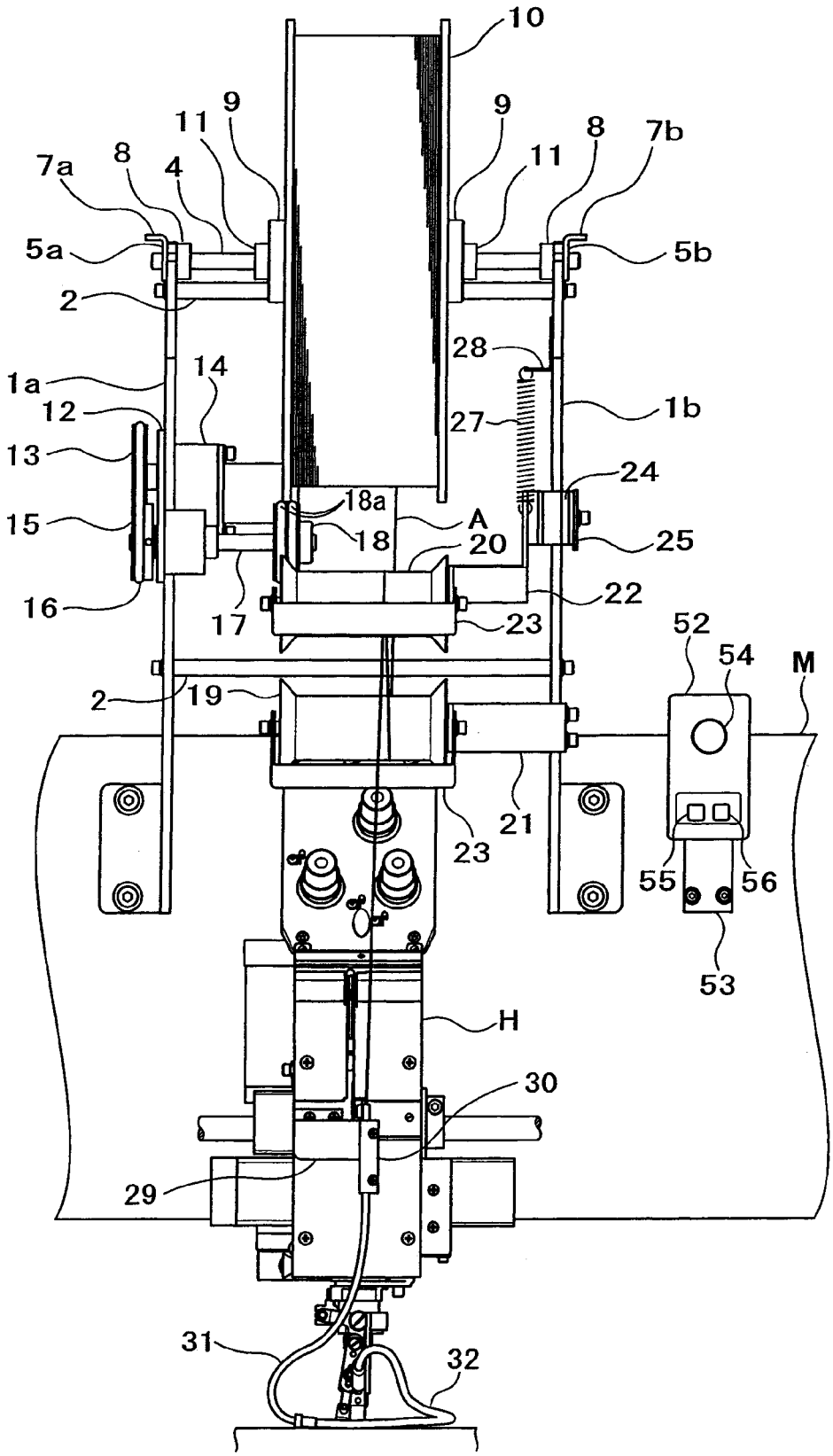
FIG. 1 is a front view showing an external appearance of part of an embroidering sewing machine in accordance with an embodiment of the present invention.
Figure 2:
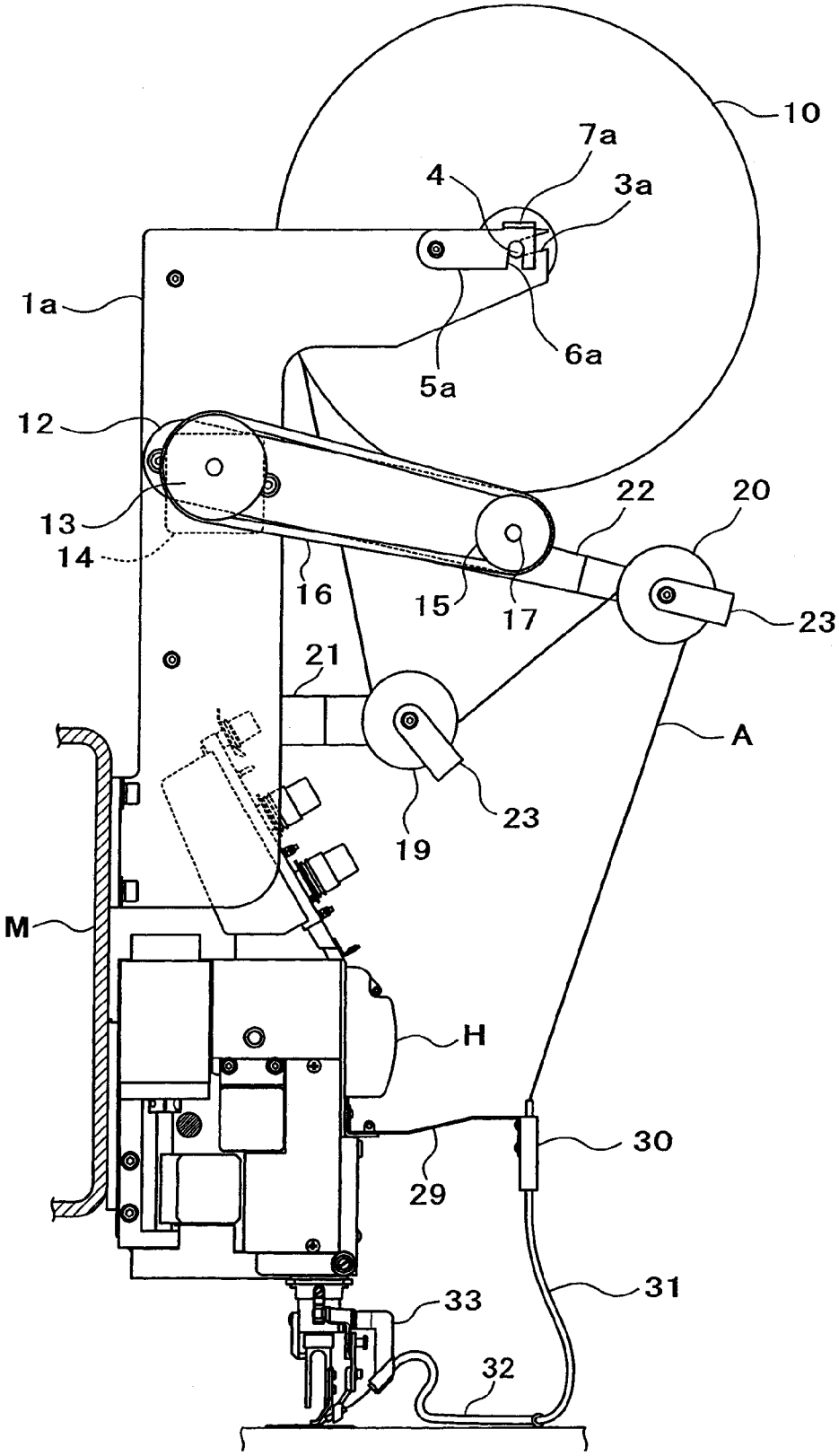
FIG. 2 is a left side view of the embroidering sewing machine taken from a left side of the machine shown in FIG. 1.
Figure 3:
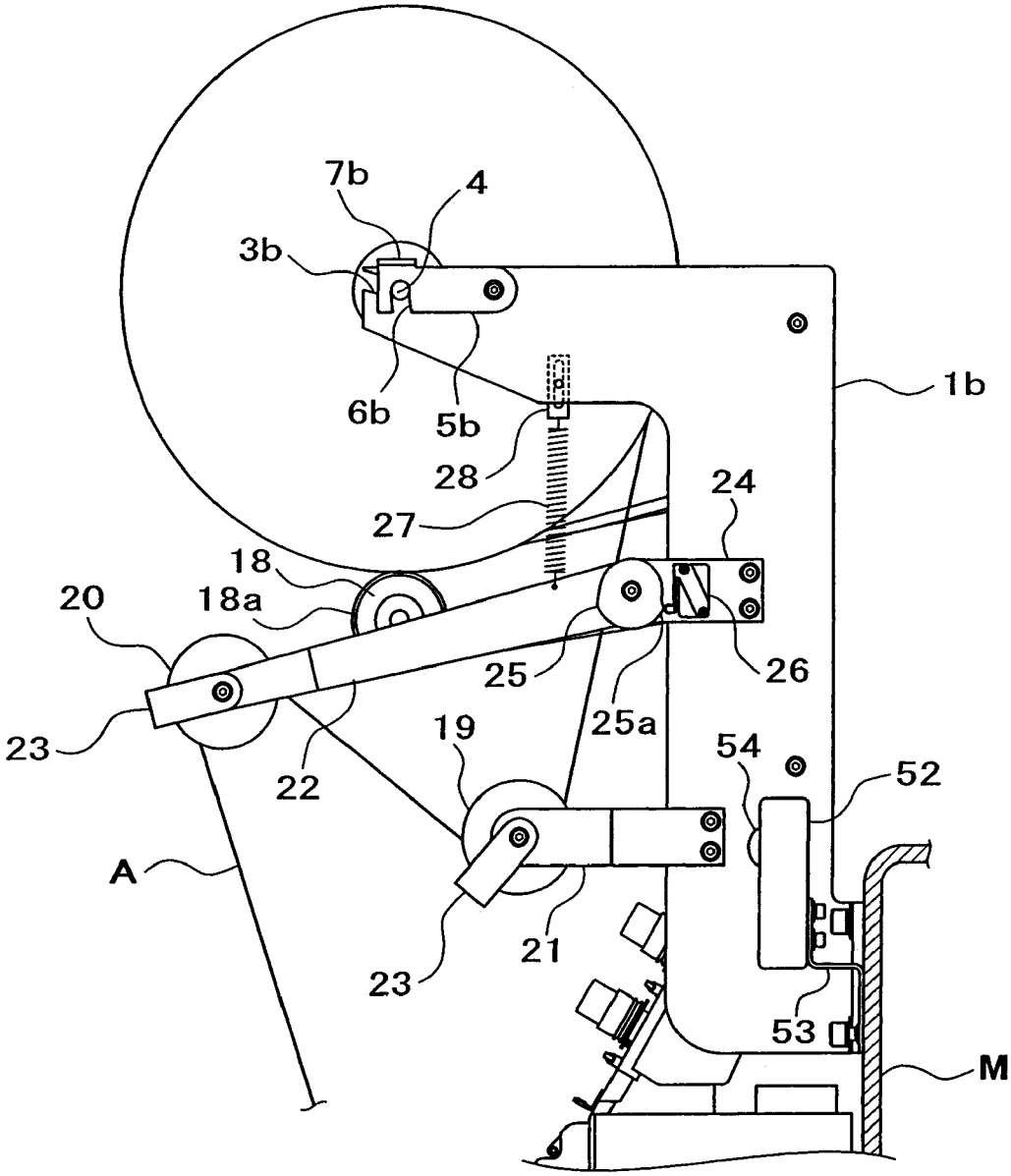
FIG. 3 is a right side view of the embroidering sewing machine taken from a right side of the machine shown in FIG. 1.

FIG. 1 is a front view showing an external appearance of part of an embroidering sewing machine of the present invention. FIG. 2 is a left side view of the embroidering sewing machine taken from a left side of the machine shown in FIG. 1. FIG. 3 is a right side view of the embroidering sewing machine taken from a right side of the machine shown in FIG. 1. Construction of the embroidering sewing machine will be described below with primary reference to FIGS. 1 to 3. Whereas a plurality of machine heads H are disposed at predetermined intervals on a front surface (i.e., a surface closer to a reader of FIG. 1, right side surface in FIG. 2, and left side surface in FIG. 3) of a machine frame M, only one of the machine heads H is shown in the figures to facilitate understanding of the following description. In addition to such machine heads H, a pair of support members 1*a* and 1*b* have respective one ends fixed, via bolts or the like, to predetermined left and right side positions of the front surface of the machine frame M with the machine heads H interposed therebetween. Two reinforcing rods 2 connect between and are secured to ends of the support members 1*a* and 1*b* opposite from the one ends.

As seen from FIGS. 2 and 3, the support members 1*a* and 1*b* are each formed into a shape having an arm section extending forward in a horizontal direction, and the two arm sections of the support members 1*a* and 1*b* have bearing recessed portions 3*a* and 3*b* formed at their respective distal ends. These bearing recessed portions 3*a* and 3*b* are rotation bearings rotatably supporting opposite end portions of a bobbin shaft 4. Further, lock members 5*a* and 5*b* are pivotably provided, on the two support members 1*a* and 1*b*, for locking the bobbin shaft 4 in the bearing recessed portions 3*a* and 3*b* so as to prevent the bobbin shaft 4 from accidentally getting out of the bearing recessed portions 3*a* and 3*b* and thereby prevent a bobbin 10 from falling. The lock members 5*a* and 5*b* each have an engaging recessed portions 6*a* or 6*b* for engaging the bobbin shaft 4, and a handle portion 7*a* or 7*b*. User of the sewing machine can attach and detach the bobbin 10, together with the bobbin shaft 4, to and from the machine, by manually pivoting the lock members 5*a* and 5*b* by means of the handle portions 7*a* and 7*b*.

As seen from FIG. 1, collars 8 are fixed to the bobbin shaft 4 near opposite ends of the shaft 4, so as to regulate left and right positions (i.e., left and right positions in FIG. 1) of the bobbin shaft 4 by abutting against the inner side surfaces of the support members 1*a* and 1*b*. Further, a pair of retaining members 9 are rotatably mounted on the bobbin shaft 4, and these retaining members 9 are also slidable in the axial direction of the bobbin shaft 4. The retaining members 9 have outer peripheral surfaces tapering from mutually-opposed inner sides toward outer sides (not shown). The bobbin 10 having a string material, such as a tape or cord, wound thereon is positioned between the two retaining members 9, and the thus-positioned bobbin 10 is supported by the tapering surfaces of the two retaining members 9. Namely, because the two retaining members 9 can deal with different inner diameters of various bobbins 10 by being moved toward or away from each other, the retaining members 9 can fix various bobbins 10 of different inner diameters. After the bobbin 10 has been retained by the two retaining members 9, stoppers 11 are fixedly mounted on the bobbin shaft 4 in contact with the outer surfaces of the retaining members 9 so that the two retaining members 9 are positioned as desired in the axial direction. By positioning the two retaining members 9 in the axial direction, the bobbin 10 can be disposed above the machine head H.

Figure 4:
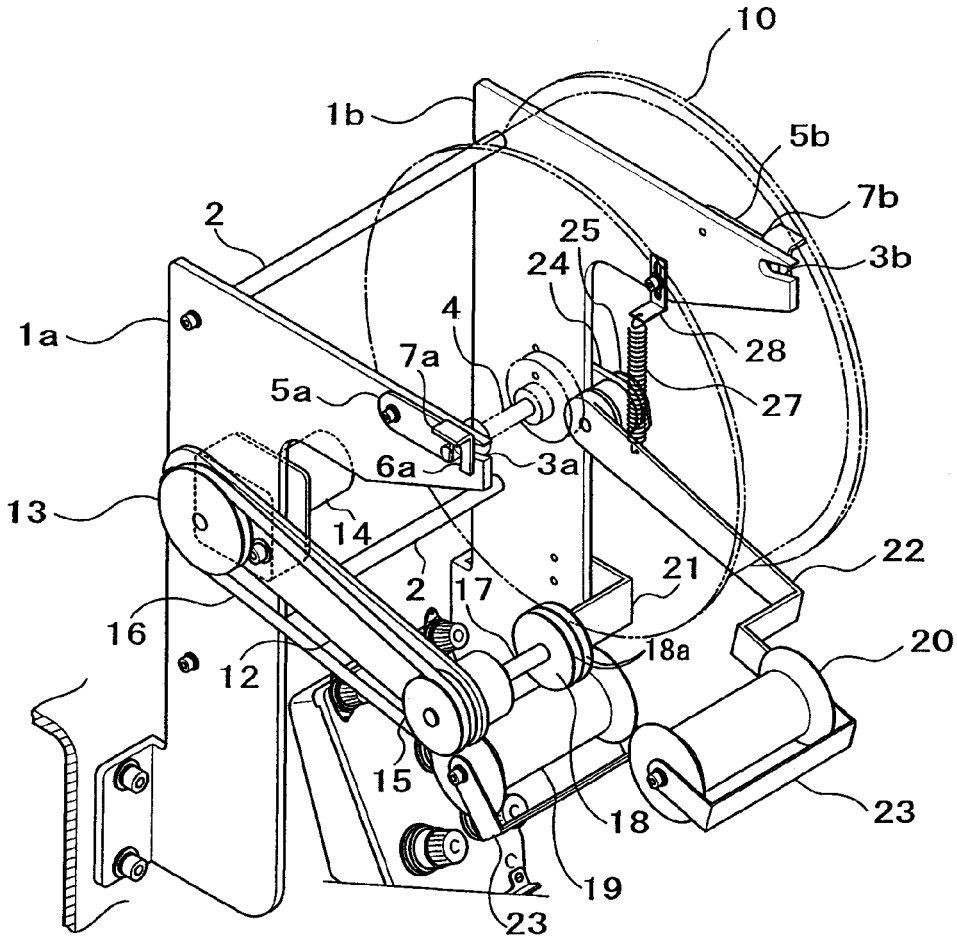
FIG. 4 is a perspective view showing in enlarged scale an external appearance of part of the embroidery sewing machine of FIG. 1.

As seen from FIG. 2 in particular, a support plate 12 is fixed to the support member 1*a*, located in a left side area in FIG. 1, in such a manner that it projects in a rightward direction of FIG. 2 toward a lower end portion of the bobbin 10. Driving pulley 13 is disposed on a proximal end portion of the support plate 12 and fixedly mounted on a motor shaft of a drive motor 14 that is in turn fixed to the support member 1*a*. Driven pulley 15 is rotatably provided on a distal end portion of the support plate 12, and a round belt 16 is wound on and operatively connect the driven pulley 15 and driving pulley 13. The driven pulley 15 is fixed to one end of a shaft 17 rotatably supported on a distal end portion of the support plate 12, and a rotary pulley 18 having a non-slip member (e.g., two round belts) 18*a* wound thereon is fixed to the other end of the shaft 17 (see FIG. 3). The rotary pulley 18 is held in abutment against the lower end of a left flange of the bobbin 10 via the non-slip member 18*a* (see FIG. 4). Thus, as the driving pulley 13 rotates by being driven by the drive motor 14, the rotation of the driving pulley 13 is transmitted via the round belts 16 to the driven pulley 15, which rotates the rotary pulley 18 fixed to the same shaft 17 as the driven pulley 15. Namely, the rotational force produced from the drive motor 14 is sequentially transmitted to the driving pulley 13, round belt 16, driven pulley 15, shaft 17 and rotary pulley 18 in accordance with driving operation of the drive motor 14, so that, ultimately, the bobbin 10 can be rotated by the thus-transmitted rotational force.

At respective predetermined positions beneath the bobbin 10, there are provided a first guide roller 19 for winding therearound and inverting upward the direction of the string material A paid out from the bobbin 10 and a second guide roller 20 for winding therearound and inverting downward the direction of the string material A inverted by the first roller 19. Here, the first guide roller 19 is rotatably mounted on a distal end portion of a support arm 21 fixed to the support member 1*b* located in a right side area in FIG. 1, while the second guide roller 20 is rotatably mounted on a distal end portion of a pivot arm 22 pivotably fixed to the support member 1*b*. Guide members 23 are provided on the guide rollers 19 and 20 in order to prevent the wound string material A from coming off the respective guide rollers 19 and 20.

Figure 5:
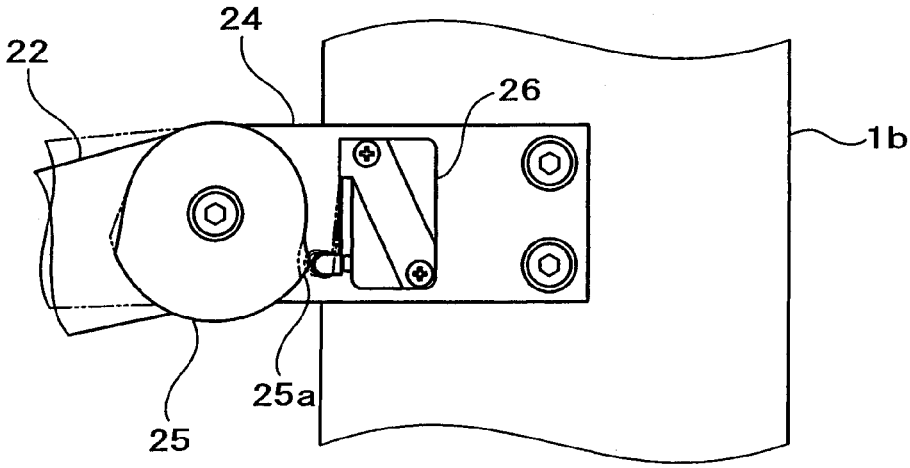
FIG. 5 is a conceptual diagram explanatory of a construction of a limit switch.

The pivot arm 22 is pivotally supported by a base member 24 fixed to the support member 1*b*, and an actuating piece 25 is fixed to a surface, opposite from the base member 24, of a proximal end portion of the pivot arm 22. The pivot arm 22 is caused to pivot, by tension applied to or acting on the string material A, about the axis of the base member 24. As the pivot arm 22 pivots, the actuating piece 25 pivots together with the pivot arm 22. As seen from FIG. 5, the actuating piece 25 has a projecting portion 25*a* for operating a limit switch 26 fixed to the base member 24; namely, the limit switch 26 is turned on/off by the pivoting movement of the actuating piece 25. The drive motor 14 is activated by the limit switch 26 being turned on, and the drive motor 14 is deactivated by the limit switch 26 being turned off. Coil spring 27 is provided between the pivot arm 22 and the arm section of the support member 1*b* for normally biasing the pivot arm 22 in the upward direction. By adjusting a position where an adjusting member 27 is mounted to the support member 1*b*, it is possible to adjust the biasing force of the coil spring 27 applied to the pivot arm 22.

Holder 30 is fixed via a bracket 29 to a front surface (i.e., a surface closer to the reader of FIG. 1, right side surface in FIG. 2, and left side surface in FIG. 3) of the machine head H, and a flexible first tube 31 for passing therethrough the string material A is fixed to the holder 30. Further, a second tube (e.g., spiral tube) 32, more flexible than the first tube 31, is connected to the distal end of the first tube 31. The second tube 32 is fixed at its distal end to a holder arm 33 that is in turn fixed to a later-described rotary bush 42 (see FIG. 6). The string material A wound around the second guide roller 20 and inverted downward can always be guided, through the two tubes 31 and 32, to a right position (sewing position) corresponding to the tip of a sewing needle 34 via a later-described guide 51 (see FIG. 6).

As shown in FIG. 1 or 3, an alarm member 52 is fixed to the front surface (i.e., the surface closer to the reader of FIG. 1, and left side surface in FIG. 3) of the machine frame M via a bracket 53. The alarm member 52 employed in the instant embodiment includes a sound-volume adjusting volume control55 for adjusting the volume of an alarm sound that is generated when the sewing needle 34 sticks or runs into a heater line, and a sensitivity adjusting volume control 56 for adjusting the sensitivity with which to detect that the sewing needle 34 has run into the heater line. The alarm member 52 operates in a case where the string material A is a heater line and informs a human operator of an abnormal state when the sewing needle 34 has run into the heater line. Namely, if the sewing needle 34 runs into the heater line in sewing the heater line onto the fabric, it forms a hole in the outer covering tube of the heater line, and the resultant product will be a defective product. Thus, in case the sewing needle 34 has run into the heater line, the alarm member 52 not only illuminates an alarm lamp 54 and produces the alarm sound to thereby inform the human operator of the abnormal state, but also deactivates the embroidery sewing machine so that the sewing operation is not performed any longer. In this way, the human operate can readily confirm visually and auditorily that the sewing needle 34 has run into the heater line and promptly take an appropriate action, such as one for halting further sewing operation.

Figure 6:
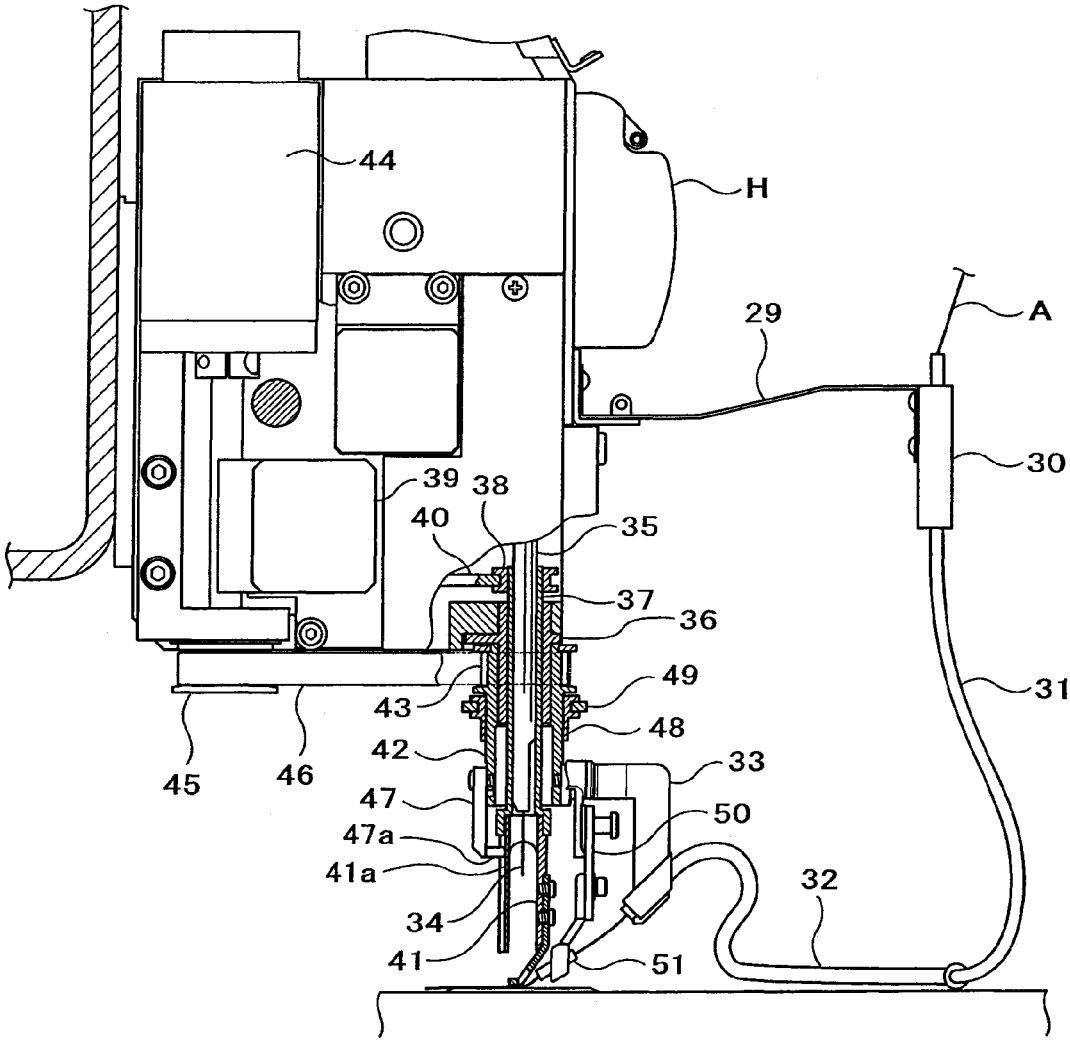
FIG. 6 is a partly-section side view of a machine head.

Now, an example detailed construction of the machine head H will be described with primary reference to FIG. 6. FIG. 6 is a partly-sectional side view of the machine head H. The machine head H is a conventional machine head, and a needle bar 35 with the sewing needle 34 fixed to its lower end is vertically-movably provided on the machine head H. Guide pipe 36 is fixed to a bottom plate of the machine head H, and a fabric-holder driving pipe 37 is provided within the guide pipe 36 in such a manner that it is vertically movable along and pivotable about the axis of the guide pipe 36. The needle bar 35 is passed through the fabric-holder driving pipe 37 for vertical movement along the pipe 37. Engaging ring 38 is fixed to and along the outer periphery of an upper end portion of the fabric-holder driving pipe 37, and a stroke arm 40, vertically movable via a motor 39, is held in engagement with the engaging ring 38. Fabric holder 41 is fixed to a lower end portion of the fabric-holder driving pipe 37. The rotary bush 42 is provided along the outer periphery of the guide pipe 36 in such a manner that it is rotatable about the axis of the needle bar 35. Timing pulley section 43 is formed on the outer periphery of an upper end portion of the rotary bush 42. The timing pulley section 43 is operatively connected, via a timing belt 46, with a driving pulley 45 that is rotatable via a motor 44. With such arrangements, the rotary bush 42 can be rotated by activation of the motor 44.

Engagement member 47 is fixed to the rotary bush 42 and extends downward therefrom, and the engaging member 47 has, at its distal end, an engagement section 47*a* engaged in a grove 41*a* formed vertically in the fabric holder 41. Thus, the fabric holder 41 is vertically movable along and rotatable about the axis of the needle bar 45 together with the rotary bush 42. Interlocking member 48 is provided along the outer periphery of the rotary bush 42 in such a manner that it is vertically movable and rotatable together with the rotary bush 42. Ring 49 vertically movable via a not-shown drive source is provided in a groove formed in the outer periphery of the interlocking member 48. Further, a guide lever 50

(e.g., zigzag swing lever) is rotatably provided on the outer peripheral surface of the rotary bush 42. The guide lever 50 is connected with the interlocking member 48 so as to pivot in response to the vertical movement of the interlocking member 48, and a pipe-shaped guide 51 for guiding the string material A to the sewing position of the sewing needle 34 is fixed to the lower end of the guide lever 50.

The following paragraphs describe how the above-described embroidering sewing machine operates to sew a string material A, such as a tape, to a fabric (not shown) by lock switching.

First, the string material A wound on the bobbin 10 is paid out and guided to the sewing position of the sewing needle 34 via the first guide roller 10, second guide roller 20, first tube 31, second tube 32 and guide 51, as explained above. Then, control is performed, on the basis of embroidery data, such that the not-shown fabric is moved in X- and Y-axis directions and the needle bar 35 is vertically driven to perform the well-known lock stitching by the sewing needle 34 in conjunction with a not-shown rotary hook. During that time, the fabric holder 41 is driven vertically, at predetermined timing relative to the vertical movement of the needle bar 35, to perform the fabric holding function, as well known in the art. Further, the ring 49 is driven vertically, at predetermined timing relative to the vertical movement of the needle bar 35, in response to which the interlocking member 48 is vertically moved to cause the guide lever 50 to pivot. As a consequence, the string material A, having been guided to the sewing position of the sewing needle 35 by the guide 51 fixed to the lower end of the guide lever 50, is swung to the left and right of the sewing position, for example, per vertical reciprocation (i.e., per stitch) of the needle bar 35. In this way, the string material A can be sequentially sewn onto the fabric by so-called "zigzag switching".

During that time, the rotary bush 42 is rotated by the motor 44 via the driving pulley 45, timing belt 46 and timing pulley 43, in response to which the guide 51 is controlled to be positioned forward in a direction of relative movement of the machine head H based on the movement of the fabric. In this way, the string material A can be appropriately guided to the sewing position of the sewing needle 34. If the rotary bush 42 is rotated more than 360 degrees, the second tube 32 might get undesirably entwined around the machine head H; thus, it is necessary that the embroidery data be made so as not to rotate the rotary bush 42 more than 360 degrees.

As the string material A is sequentially sewn onto the fabric in the above-described manner, the second guide roller 20 is pulled by the string material A so that the pivot arm 22 is caused to pivot downward. Then, the actuating piece 25 fixed to the proximal end portion of the pivot arm 22 pivots in a counterclockwise direction (of FIG. 3) in response to the pivotal movement of the pivot arm 22. Once the pivot arm 22 pivots to a position as shown in FIG. 3, the projecting portion 25*a* of the actuating piece 25 turns on the limit switch 26. As the limit switch 26 is turned on in the aforementioned manner, the drive motor 14 is activated to rotate the bobbin 10 so that the string material A is paid out from the bobbin 10. When the tension of the string material A has decreased as the string material A is paid out from the bobbin 10, the pivot arm 22 is caused to pivot upwardly by the biasing force of the coil spring 27, and then, the pivot arm 22 pivots in a clockwise direction (of FIG. 3) in response to the pivotal movement of the pivot arm 22. Once the pivot arm 22 pivots upwardly beyond the position shown in FIG. 3, the projecting portion 25*a* of the actuating piece 25 terminates the ON state of the limit switch 26 (i.e., turns off the limit switch 26). Once the limit switch 26 is turned off in this way, the drive motor 14 is deactivated so that the rotation of the bobbin 10 is terminated. After that, when the pivot arm 22 has again pivoted downward as the string material A is sewn onto the fabric, the bobbin 10 is rotated to pay out the string material A, and then, the rotation of the bobbin 10 is terminated once a sufficient amount of the string material A is paid out. By thus repeating the rotation and termination of the rotation of the bobbin 10 through ON/OFF control of the drive motor 14 performed in accordance with the tension of the string material A, it is possible to smoothly pay out the string material A to the sewing position of the sewing needle 34.

In the embodiment of the embroidery sewing machine, as described above, the bobbin 10 is located above the machine head H, and thus, the bobbin 10 can have an increased size so that an increased amount of the string material A can be wound on the bobbin 10. Further, with the arrangement that the bobbin 10 is driven to rotate by the drive motor 14, the embodiment of the invention allows the string material A to be smoothly paid out from the bobbin 10 by positively rotating the bobbin 10 in accordance with the tension of the string material A, even where the bobbin 10 has an increased weight due to a great amount of the string material A wound thereon. Namely, in sewing the string material A, the embodiment allows the bobbin 10 to rotate and stop rotating in accordance with a paid-out amount of the string material A. Because the string material A can be paid out smoothly in this way, the string material A can be sewn to the fabric accurately and beautifully.

Note that the drive motor 41 for rotating the bobbin 10 may be arranged to directly rotate the rotary pulley 18 or directly rotate the bobbin shaft 4.

Further, whereas the embodiment of the invention has been described as sewing the string material A onto the fabric by so-called zigzag stitching, the present invention is, of course, not so limited.

Furthermore, the tension of the string material A may be detected, via a sensor or the like, so that the drive motor 14 is controlled on the basis of the detected tension to pay out the string material A.

Note that the terms "string material" used in connection with the present invention embrace all kinds of elongated sewn materials, not to mention tapes and cords, as long as the elongated sewn materials has flexibility such that they can be wound and held on the bobbin (i.e., rotary holder member). Furthermore, the object of sewing, onto which the sewn material is to be sewn, may be other than a fabric. Furthermore, the object of sewing need not be of a web, sheet or planar shape and may be of a curved shape or other shape having a curved surface, or a fragment. Furthermore, the present invention is not limited to the type of embroidery sewing machine where an embroidery frame having the object of sewing (fabric) held thereon is moved in accordance with sewing data, and is also applicable to another type of embroidery sewing machine where a needle drop position is moved in accordance with sewing data.

The bobbin (rotary holder member) may be driven by the motor in any other suitable manner than that described above in relation to the preferred embodiment. For example, the sewn material (string material A) may normally be paid out, in response to a drawing or pulling force produced in accordance with a progression of the sewing operation, from the bobbin (rotary holder member) through free rotation of the bobbin, and, upon detection of tension mote than a predetermined level, the motor may be activated to assist the bobbin (rotary holder member) in the free rotation (i.e., rotation as a follower).

The invention claimed is:

1. A sewing machine including: a reciprocally-driven needle bar; a sewing needle fixed to a distal end of the needle bar; a rotary member provided concentrically with the needle bar for rotation about an axis of the needle bar; a rotary holder member having an elongated sewn material wound thereon; and a guide for guiding the sewn material, paid out from the rotary holder member, to a sewing position of the sewing needle, the guide being provided for rotation together with the rotary member, said sewing machine sewing the sewn material onto an object of sewing while adjusting an orientation of the guide by controlling the rotation of the rotary member, said sewing machine comprising:

a tension detector that detects tension acting on the sewn material paid out from said rotary holder member; and a drive device that drives said rotary holder member to rotate, driving operation of the drive device being controlled on the basis of detection, by said tension detector, of the tension.

2. A sewing machine as claimed in claim 1 wherein said tension detector includes a displacement member mechanically displaceable in accordance with the tension acting on the sewn material, and a detector for detecting displacement of said displacement member.

3. A sewing machine as claimed in claim 2 wherein said detector is a limit switch that is turned on or off in accordance with a displaced position of said displacement member or said deflection member.

4. A sewing machine as claimed in claim 1 which further comprises a deflection member for changing a direction of the sewn material paid out from said rotary holder member, said deflection member is mechanically displaceable in accordance with the tension acting on the sewn material, and wherein said tension detector includes a detector for detecting displacement of said deflection member.

5. A sewing machine as claimed in claim 4 wherein said detector is a limit switch that is turned on or off in accordance with a displaced position of said displacement member or said deflection member.

6. A sewing machine as claimed in claim 1 wherein said drive device is activated when the tension acts on the sewn material, to drive said rotary holder member to rotate in a direction to pay out the sewn material.

7. A sewing machine as claimed in claim 6 wherein said rotary holder member is a bobbin of a relatively large size positioned in a space above said needle bar.

8. A sewing machine as claimed in claim 6 wherein the sewn material is a string material.

9. A sewing machine as claimed in claim 1 wherein said rotary holder member is a bobbin of a relatively large size positioned in a space above said needle bar.

10. A sewing machine as claimed in claim 1 wherein the sewn material is a string material.

* * * * *